US006497320B2

(12) United States Patent
Kondo et al.

(10) Patent No.: US 6,497,320 B2
(45) Date of Patent: Dec. 24, 2002

(54) CONVEYOR

(75) Inventors: Masakatsu Kondo, Tokushima (JP); Takayoshi Kamiji, Tokushima (JP); Michio Ueda, Tokushima (JP)

(73) Assignee: Shikoku Kakoki Co., Ltd., Tokushima (JP)

( * ) Notice: Subject to any disclaimer, the term of this patent is extended or adjusted under 35 U.S.C. 154(b) by 0 days.

(21) Appl. No.: 09/794,013

(22) Filed: Feb. 28, 2001

(65) Prior Publication Data

US 2001/0019007 A1 Sep. 6, 2001

(30) Foreign Application Priority Data

Mar. 1, 2000 (JP) ..... 2000-055219

(51) Int. Cl.[7] ..... B65G 43/00

(52) U.S. Cl. ..... 198/502.3; 198/341.01; 198/626.5

(58) Field of Search ..... 198/341.01, 502.3, 198/810.01, 810.03, 718, 726, 626.1, 626.5, 626.6, 502.4; 53/371.3, 564, 565; 141/177

(56) References Cited

U.S. PATENT DOCUMENTS 2,794,536 A 6/1957 Roza et al. ..... 198/82
4,172,347 A * 10/1979 Nitz ..... 198/502.3
4,641,742 A 2/1987 Igarashi et al. ..... 198/627
4,818,540 A 4/1989 Chien et al. ..... 424/448
5,337,885 A * 8/1994 Mills et al. ..... 198/502.4

FOREIGN PATENT DOCUMENTS

| | | |
|---|---|---|
| EP | 0 574 087 | 12/1993 |
| EP | 0 945 372 | 3/1999 |
| WO | WO 96/41760 | 12/1996 |

* cited by examiner

*Primary Examiner*—Joseph E. Valenza
(74) *Attorney, Agent, or Firm*—Armstrong, Westerman & Hattori, LLP

(57) ABSTRACT

A conveyor has a rotary encoder for measuring the amount of rotation of a driven sprocket having an intermittently drivable chain reeved therearound, and a processor for processing the measurement obtained by the encoder as operation support operating data corresponding to the amount of rotation of the driven sprocket. The processor determines a reference position of the chain in time series when the chain is moved a distance at a time by intermitting driving, computes the actual position of the chain corresponding to the reference position based on the measurement obtained by the encoder, and computes the deviation of the actual position of the chain from the reference position.

4 Claims, 7 Drawing Sheets

CONVEYOR

BACKGROUND OF THE INVENTION

The present invention relates to container conveyors, for example, for use in packaging machines.

Conveyors of the type mentioned are already known which comprise a drive sprocket, a driven sprocket, a chain reeved around the sprockets and drivable intermittently, and a plurality of container holders attached to the chain at a spacing corresponding to the distance the chain is moved at a time by intermittent driving. The chain has a container transport path extending successively via a group of devices including a filling device and a sealing device.

With the conveyor described, the container holders need to be brought to a halt accurately at specified operating positions such as the locations of the filling device and the sealing device. Otherwise, the required packaging operation will not be performed on the containers. However, the chain becomes inevitably stretched with time, and if exceeding a certain limit, the stretch starts to cause trouble in the packaging operation. Although maintenance is provided on the conveyor in the event of trouble arising, the procedure performed is not efficient.

SUMMARY OF THE INVENTION

An object of the present invention is to provide a conveyor wherein operation support operating data, for example, as to the halted position and movement of the chain is readily available to ensure facilitated and efficient maintenance of the chain.

The present invention provides a conveyor comprising a drive sprocket, a driven sprocket and an intermittently drivable chain reeved around the sprockets, the conveyor being characterized in that the conveyor comprises an instrument for measuring the amount of rotation of the driven sprocket, and a processor for processing the measurement obtained by the instrument as operation support operating data corresponding to the amount of rotation of the driven sprocket.

With the conveyor of the invention, the amount of rotation of the driven sprocket is measured to obtain operation support operating data based on the measurement. This assures the chain of facilitated and efficient maintenance.

The processor comprises setting means for determining a reference position of the chain in time series when the chain is moved a distance at a time by intermitting driving, means for computing the actual position of the chain corresponding to the reference position based on the measurement obtained by the instrument, and means for computing the deviation of the actual position of the chain from the reference position. This enables the operator to observe the dynamic variations involved in the movement of the chain when it is moved a specified distance at a time by intermittent driving.

The processor may comprise setting means for determining a reference halted position of the chain every time the chain is moved a distance by intermitting driving during one turn of movement, means for computing the actual halted position of the chain corresponding to the reference halted position based on the measurement obtained by the instrument, and means for computing the deviation of the actual halted position of the chain from the reference halted position. This enables the operator to observe the static variations involved in one turn of movement of the chain.

The present invention provides another conveyor comprising a pair of drive sprockets, a pair of driven sprockets and a pair of intermittently drivable chains each reeved around the drive sprocket and the driven sprocket corresponding to the chain, the conveyor being characterized in that the conveyor comprises a first instrument for measuring the amount of rotation of one of the driven sprockets, a second instrument for measuring the amount of rotation of the other driven sprocket, and a processor for processing the measurements obtained by the two instruments as operation support operating data.

The invention is useful also for the maintenance of the pair of chains included in this conveyor.

The processor of the conveyor comprises setting means for determining reference halted positions of the respective chains every time the chains are moved a distance by intermitting driving during one turn of movement, means for computing the actual halted position of each of the chains corresponding to the reference halted position of the chain based on the measurement obtained by the corresponding instrument, and means for computing the deviation of the actual halted position from the reference halted position. This enables the operator to observe the static variations involved in one turn of movement of the pair of chains.

When a plurality of container holders are attached to the chain at a spacing corresponding to the distance the chain is moved at a time by intermittent driving, and further when the chain has a container transport path extending successively via a group of devices including a filling device and a sealing device, each container holder can be brought to a halt at a desired operating position of the group of devices.

DESCRIPTION OF THE PREFERRED EMBODIMENT

An embodiment of the present invention will be described below with reference to the drawings.

Figure 1:
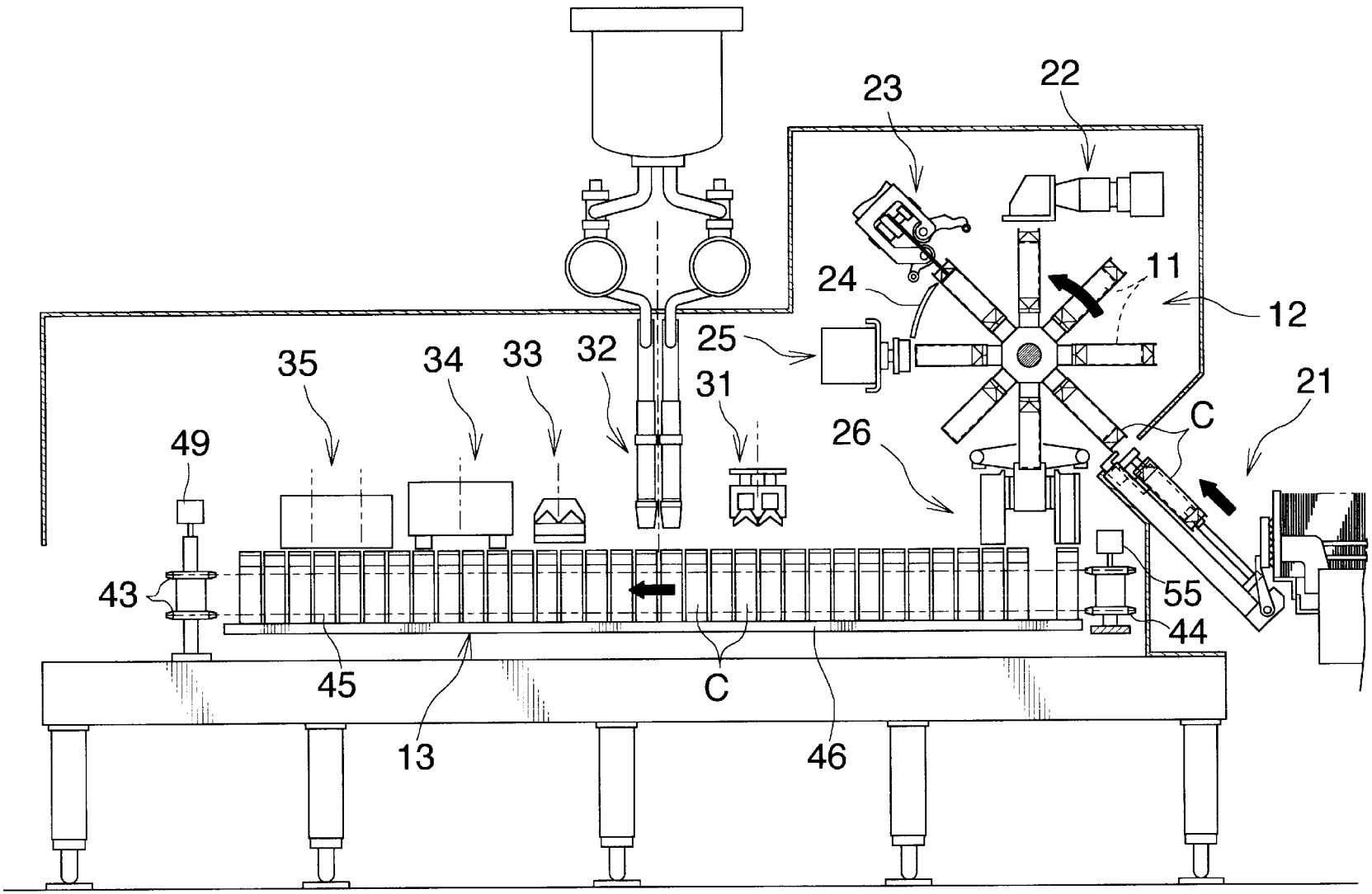
FIG. 1 is an overall side elevation showing a packaging machine including a conveyor embodying the invention.

As shown schematically in its entirety in FIG. 1, a packaging machine comprises a container bottom forming rotor 12 provided with radial mandrels 11 each having fitted therearound a container C of square to rectangular cross section and intermittently drivable counterclockwise, and a container conveyor 13 having a transport path forwardly extending from below the rotor 12.

Arranged one after another around the rotor 12 toward the direction of rotation of the rotor are a feeder 21, bottom heater 22, bottom breaker 23, folding rail 24, bottom press 25 and unloader 26. Successively arranged along the path of transport of the conveyor 13 are a primary top breaker 31, filling device 32, secondary top breaker 33, top heater 34 and top sealing device 35.

Figure 2:
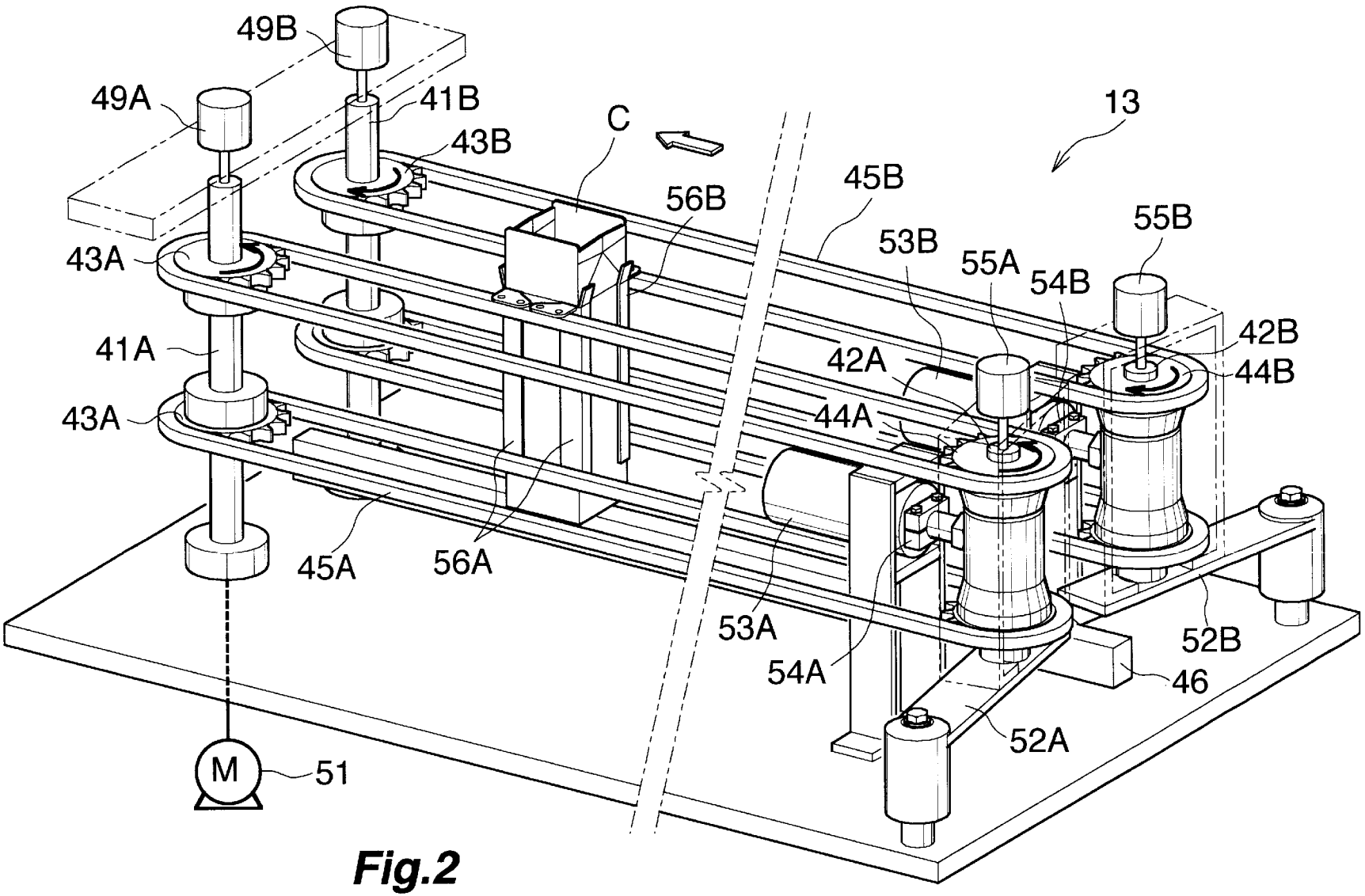
FIG. 2 is a perspective view of the conveyor of the invention.

With reference to FIG. 2, the conveyor 13 comprises a pair of left and right vertical drive shafts 41A, 41B, a pair of left and right vertical support rods 42A, 42B arranged in the rear of and spaced apart from these drive shafts 41A, 41B, upper and lower two left drive sprockets 43A fixed to the left drive shaft 41A and vertically spaced apart, upper and lower two right drive sprockets 43B fixed to the right drive shaft 41B and vertically spaced apart, upper and lower two left driven sprockets 44A mounted on the left support rod 42A and vertically spaced apart, upper and lower two right driven sprockets 44B mounted on the right support rod 42B and vertically spaced apart, upper and lower two left chains 45A reeved around the left drive sprockets 43A and the left driven sprockets 44A at upper and lower levels, respectively, upper and lower two right chains 45B reeved around the right drive sprockets 43B and the right driven sprockets 44B at upper and lower levels, respectively, and a horizontal guide rail 46 extending forward below the space between the left and right chains 45A, 45B.

A pair of left and right rotary encoders 49A, 49B are connected to the respective drive shafts 41A, 41B. Among the two left and two right driven sprockets 44A, 44B at the upper and lower levels, the left and right driven sprockets 44A, 44B at the upper level have a pair of left and right rotary encoders 55A, 55B, respectively.

The support rods 42A, 42B are supported upright on free ends of a pair of left and right horizontal pivotal arms 52A, 52B, respectively. A pair of fluid pressure cylinders 53A, 53B are directed rearward and have piston rods, which are connected to the respective support rods 42A, 42B. The fluid pressure cylinders 53A, 53B are horizontally pivotably supported at their cylinder side, and the piston rods can releasably be locked at a desired advanced or retracted position by the respective lock mechanisms 54A, 54B. The cylinders 53A, 53B each have incorporated therein a distance (displacement) sensor for measuring the amount of advance or retraction of the piston rod.

A plurality of L-shaped vertical pieces 56A extend between and are attached to the two left chains 45A, and a plurality of L-shaped vertical pieces 56B corresponding to the pieces 56A extend between and are attached to the two right chains 45B.

With reference to FIG. 2, a servomotor 51 intermittently drives the left drive shaft 41A counterclockwise when seen from above, and the right drive shaft 41B clockwise as timed with the shaft 41A, whereby the opposed portions of the left and right chains 45A, 45B are moved forward, providing a path of movement for feeding. Each pair of L-shaped pieces 56A and each pair of L-shaped pieces 56B on the respective left and right chains 45A, 45B form a holder. The holder traveling the feeding path fits to the four corners of the container C, which is transported with its bottom supported by the guide rail 46.

The servomotor 51 is controlled by an unillustrated controller, and the chains 45A, 45B can be brought to a halt at desired positions, for example, with pulses provided by the controller.

When the chains 45A, 45B become stretched owing to the operation of the conveyor over a prolonged period of time, the piston rods of the fluid pressure cylinders 53A, 53B are advanced as unlocked from the lock mechanisms 54A, 54B, causing the cylinders 53A, 53B to apply pressures to the chains 45A, 45B to make the chains 45A, 45B taut. The piston rods are then locked by the lock mechanisms 54A, 54B again. This procedure is advantageous from the viewpoint of the stretch of the chains 45A, 45B since the pressures of the cylinders 53A, 53B will not act on the chains 45A, 45B at all times. However, the chains 45A, 45B may be subjected to the pressures at all times as the case may be. The chains 45A, 45B are then used always as tensioned.

The pressures to be applied to the chains 45A, 45B by the fluid pressure cylinders 53A, 53B respectively may be the same in magnitude, or one pressure may be made greater than the other in accordance with the difference between the two chains 45A, 45B in stretch.

The angles of rotation of the left and right drive sprockets 43A, 43B are measured individually by the drive-side rotary encoders 49A, 49B, while the angles of rotation of the left and right driven sprockets 44A, 44B are measured individually by the driven-side rotary encoders 55A, 55B.

Procedures will be described below for effectively utilizing the values measured by the drive-side and driven-side rotary encoders 49A, 49B, 55A, 55B, by processing the measurements as operation support operating data.

Figure 3:
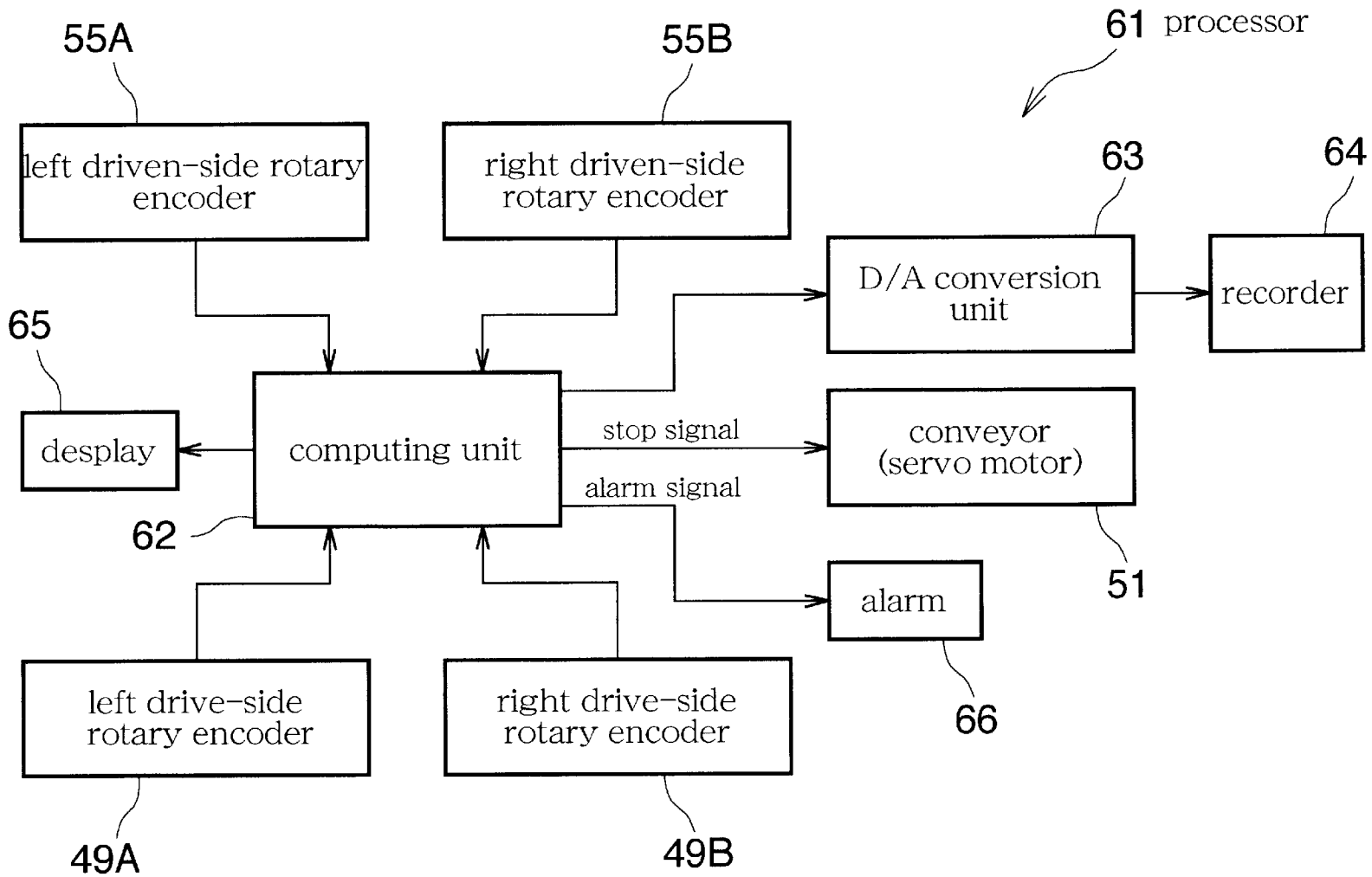
FIG. 3 is a diagram showing the construction of a data processor for the conveyor.

FIG. 3 is a diagram showing the construction of a processor 61 for a system for maintaining and supporting the operation of the conveyor. The processor 61 has a computing unit 62, which receives the measurements from the drive-side and driven-side rotary encoders 49A, 49B, 55A, 55B. The unit 62 performs the required computation based on the measurements, and the result of computation is sent to a recorder 64 via a D/A conversion unit 63 and also to a display 65. The recorder 64 records the result of computation, while the display 65 shows the result. If the result of computation is abnormal on the other hand, the computation unit 62 delivers a stop signal and an alarm signal. The conveyor is brought out of operation in response to the stop signal, while an alarm 66 gives a warning.

The drive-side rotary encoders 49A, 49B are driven by the servomotor 51, therefore operate ideally at all times and can accordingly be dispensed with. These encoders 49A, 49B are used in the present embodiment in view of the mechanical loss involved in the path from the servomotor 51 to the drive shafts 41A, 41B, and the pulse signals produced by the encoders 49A, 49B are used for providing reference values. The driven-side rotary encoders 55A, 55B produce pulse signals corresponding to the actual angles of rotation of the driven sprockets 44A, 44B and to be used as actual values. The pulse signals are converted into the angles of the rotation of the drive and driven sprockets 43A, 43B, 44A, 44B in proportion thereto and into the amounts of movements of the chains (as reeved around the sprockets) in proportion to the signals.

Figure 4:
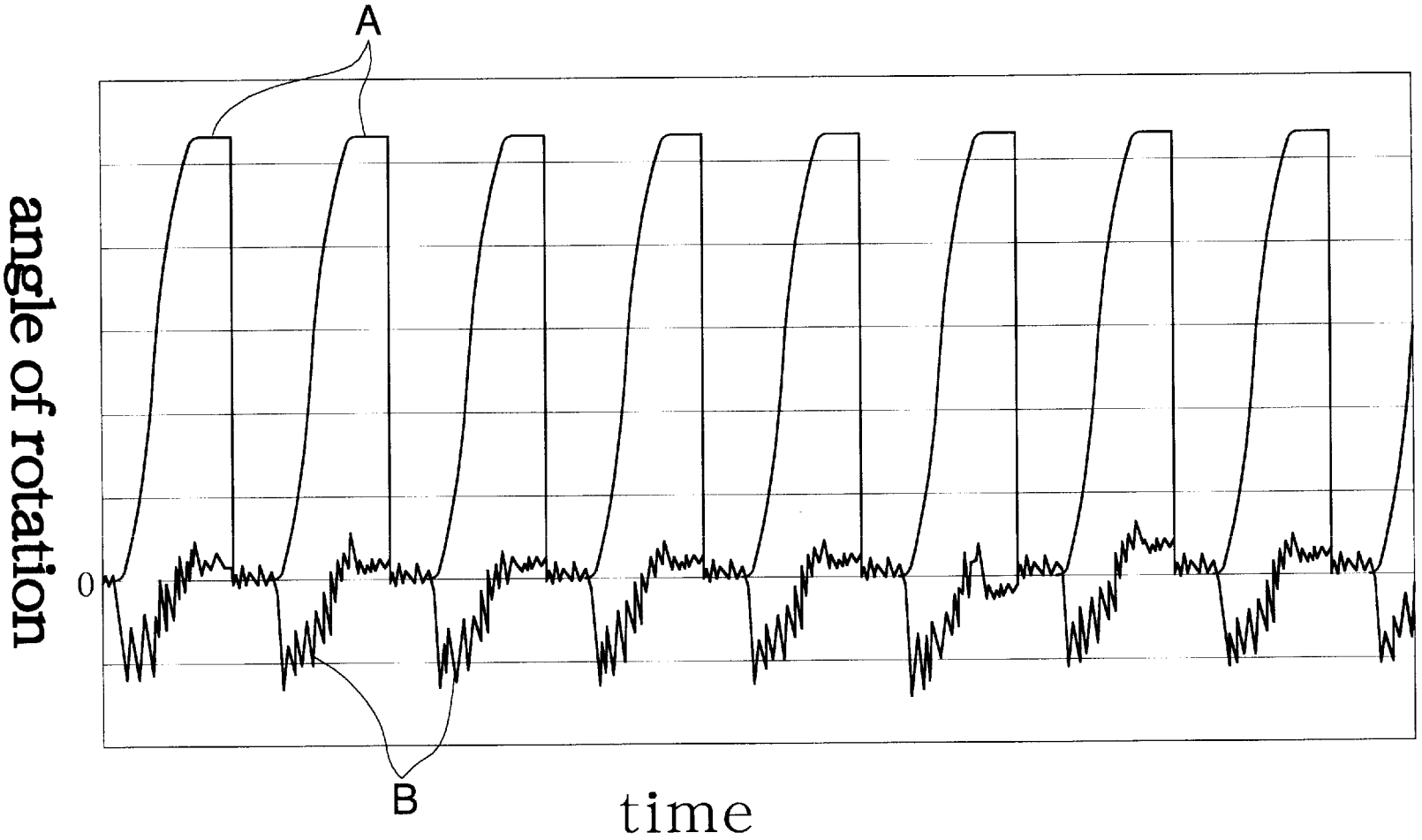
FIG. 4 is a graph showing the operation waveform of driven sprockets.

FIG. 4 shows operation waveforms of the drive and driven sprockets 43A, 43B, 44A, 44B every time the conveyor is moved a distance by being driven intermittently (each conveyor cycle). Plotted as abscissa is time vs. the angle (dimensionless) of rotation of the drive and driven sprockets as ordinate. Each wave of the operation waveform indicated at A represents the operations of the drive and driven sprockets 43A, 43B, 44A, 44B corresponding to one conveyor cycle. The waveform A is reset every cycle and returns to the origin. Since there is no difference that is discernible in the waveform A between the operations of the drive and driven sprockets 43A, 43B, 44A, 44B, the operations appear to be represented by a single common line. Accordingly, the difference in operation waveform between the drive and driven sprockets 43A, 43B, 44A, 44B is represented as enlarged 20 times by a waveform B.

Figure 5:
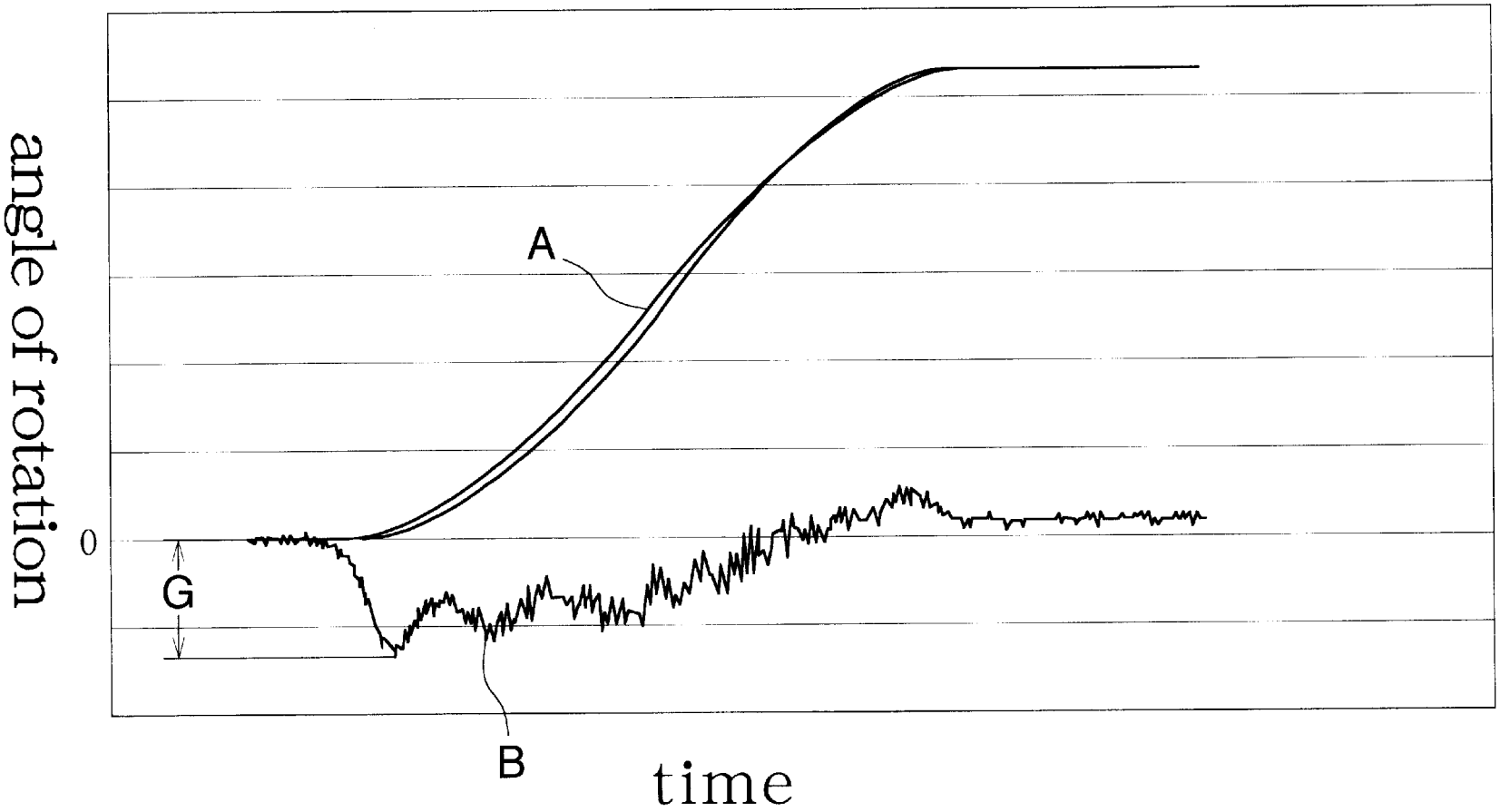
FIG. 5 is a graph showing part of FIG. 4 on an enlarged scale.

FIG. 5 shows one cycle of the operation waveform of FIG. 4 as enlarged with respect to time. It is seen that the operation of the driven sprockets 44A, 44B lags behind the operation of the drive sprockets 43A, 43B by a maximum deviation G immediately after the start of travel of the chains, thereafter gradually recovers and overtakes the operation of the drive sprockets 43A, 43B immediately before halting and comes to a halt after going on ahead of the operation of the drive sprockets. FIGS. 4 and 5 indicate dynamic variations in the operation of the chains during one cycle of conveyor operation.

The lag of the operation of the driven sprockets 44A, 44B, namely, the deviation G of the operation of the driven sprockets 44A, 44B from the operation of the drive sprockets 43A, 43B, indicates the degree to which the driven sprockets 44A, 44B follow the drive sprockets 43A, 43B and which corresponds mainly to the slackening of the chains 45A, 45B due to a stretch. The greater the deviation, the greater the tendency for the chains 45A, 45B to operate abruptly inadvertently, consequently greatly rocking the liquid filled in the container C as held by the holder. If the liquid is rocked to spill, a faulty seal will result. If the deviation exceeds a predetermined value, the computing unit 62 outputs a stop signal and an alarm signal, and required maintenance is provided. The predetermined value of deviation is, for example, 7 degrees.

Local faults in the chains 45A, 45B, biting of containers, application of an abnormal load or like trouble can be detected by monitoring the waveforms shown in FIGS. 4 and 5 at all times to halt the conveyor in an emergency.

Figure 6:
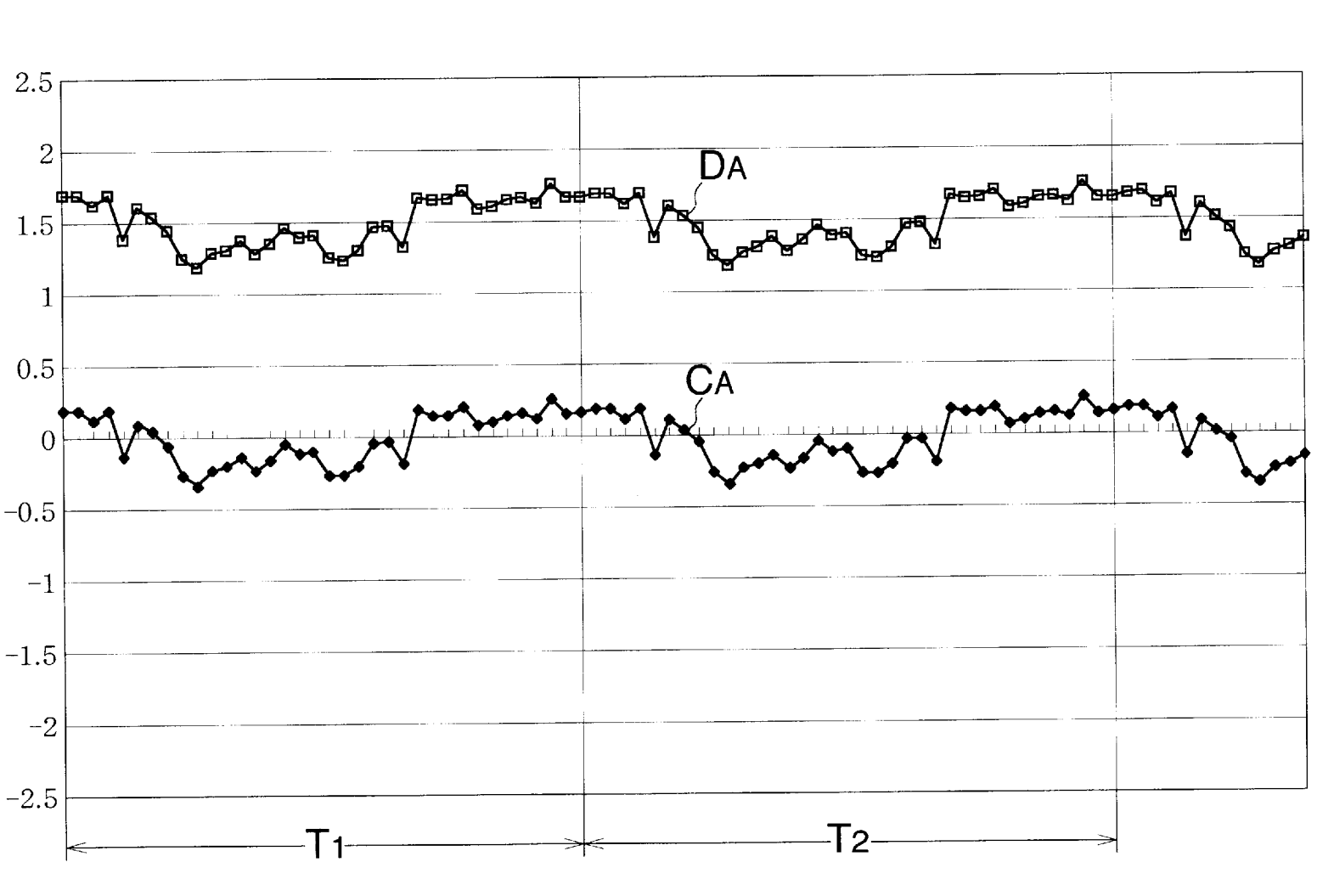
FIG. 6 is a graph showing variations in the amount of movement of a left driven sprocket.
Figure 7:
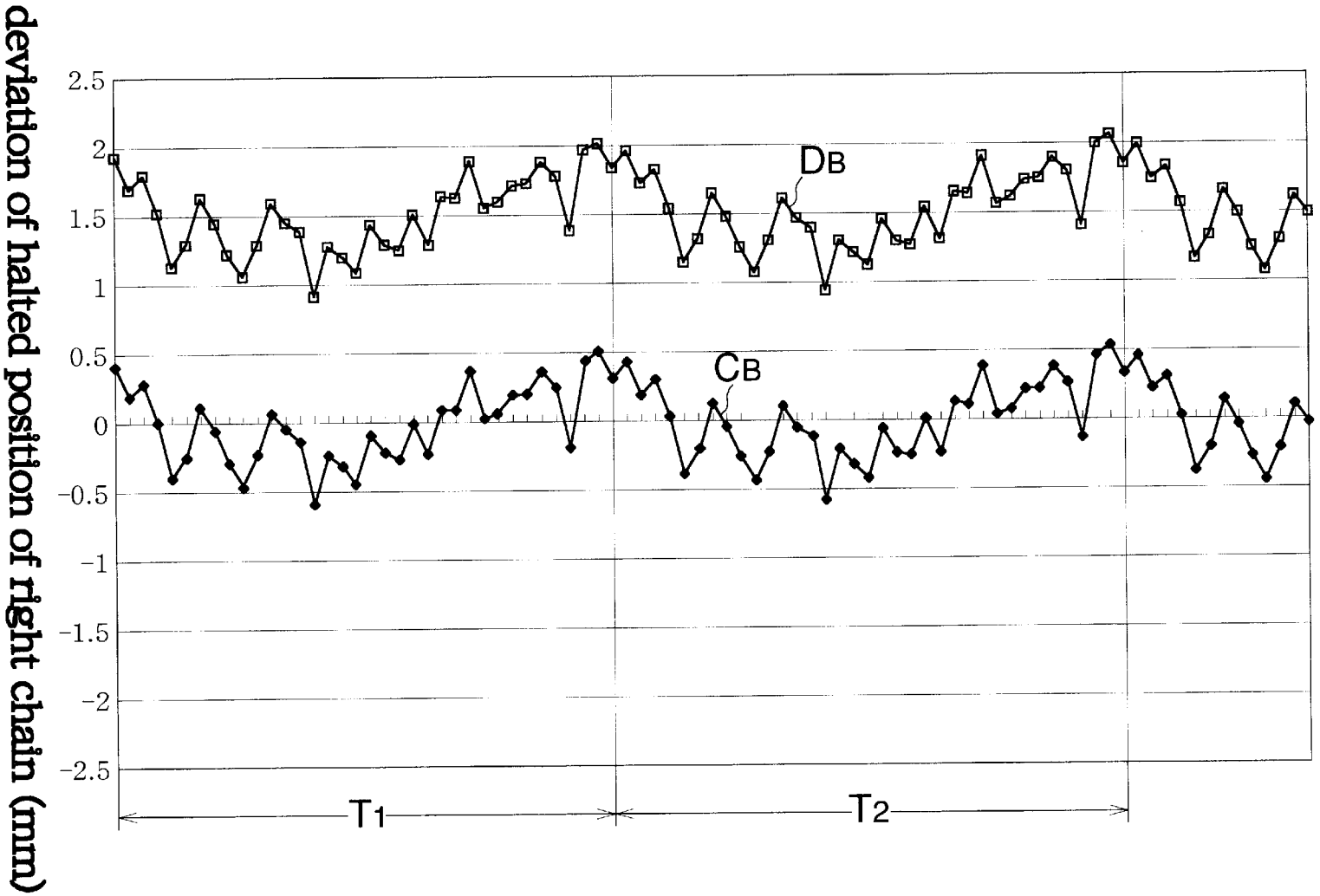
FIG. 7 is a graph showing variations in the amount of movement of a right driven sprocket.

FIGS. 6 and 7 show variations in the deviation of halted positions of the drive and driven sprockets 43A, 43B, 44A, 44B during each cycle of conveyor operation while the chains 45A, 45B make one turn, FIG. 6 showing the data for the left chain 45A, and FIG. 7 the data for the right chain 45B.

The period T1, T2 for one turn of the chains 45A, 45B is plotted as abscissa, and successively plotted as ordinate is the variation in the halted position on completion of each cycle of conveyor operation during the period T1, T2. The origin 0 is always taken as the halted positions of the drive sprockets 43A, 43B, providing reference halted positions for the chains every time the chains are moved a specified distance by intermittent driving during one turn of movement of the chains. The waveforms CA and CB represent the actual deviations of the driven sprockets 44A, 44B from the origin 0, in terms of variations in the halted position as converted in mm from the angle of rotation of each driven sprocket 44A or 44B. The waveforms CA and CB represent the data in the initial state, and the waveforms DA and DB represent the data available a specified period of time thereafter.

Noteworthy is the following fact. The pattern representing the variations in the deviation during each period T1 or T2 for one turn of movement of the chain has regularity, and the same pattern is available in each period T1 or T2.

The chains 45A, 45B stretch with time, and the resulting variations are manifest in the transition from the waveforms CA and CB to waveforms DA and DB, and are static variations. The time taken for the deviation in the pattern reaches a limit necessitating maintenance can be estimated by measuring the static variations with the lapse of time. Based on the estimated result, the computing unit 62 produces a stop signal and alarm signal. The limit of deviation is, for example, 2.0 mm at the location of the driven sprockets 44A, 44B, 2.0 mm at the location of the filling device, or 1.5 mm at the location of the sealing device.

If the pattern deviates toward the positive direction to reach the limit, adjustment is so made as to halt the chain 45A or 45B at a position shifted toward the negative direction. Containers C can then be halted at a desired operating position such as the location of the filling device, sealing device, or the like.

In the case where the pattern deviates toward the positive direction as the chain 45A or 45B stretches as described above, it is possible to lengthen the time taken for the deviation of the pattern to reach a limit necessitating maintenance, by causing the chain 45A or 45B to halt, for example, at a specific position in the pattern where the variation of the halted position is minimum, and adjusting the halted position of the chain 45A or 45B so that this position is close to the limit value at the negative side. Conversely, in the case where the pattern deviates toward the negative direction as the chain 45A or 45B stretches as described above, it is possible to lengthen the time taken for the deviation of the pattern to reach a limit necessitating maintenance, by causing the chain 45A or 45B to halt, for example, at a specific position in the pattern where the variation of the halted position is maximum, and adjusting the halted position of the chain 45A or 45B so that this position is close to the limit value at the positive side.

Although the embodiment described is adapted to measure the angles of rotation of the left and right drive and driven sprockets, the present invention can be practiced merely by measuring the angle of rotation of at least one driven sprocket. Furthermore, other device such as a laser sensor is usable in place of the rotary encoder for measuring the angle of rotation of the driven sprocket.

When the measuring instrument is provided for each of the left and right driven sprockets, the deviation patterns of the respective left and right chains are available. The deviation, in the transport direction, of the container holders (vertical L-shaped pieces) provided on the respective chains can be diminished by making such adjustment as to ensure synchronism between the two patterns.

The left and right drive sprockets may be driven by a single servomotor, whereas if these sprockets are driven individually by separate servomotors, the above adjustment can be effected automatically.

The driven sprockets and the vicinity thereof (the portion where containers are fed to the conveyor in the case of the present embodiment) which are liable to malfunction due to a stretch of the chain can be reliably monitored by providing the instrument for measuring the amount of rotation of the driven sprocket, whereby the trouble is avoidable.

The upstream side of the conveyor with respect to the container transport direction may serve as the drive portion, with the downstream side serving as the driven portion.

What is claimed is:

1. A conveyor comprising a drive sprocket, a driven sprocket and an intermittently drivable chain reeved around the sprockets, the conveyor being characterized in that the conveyor comprises an instrument for measuring the amount of rotation of the driven sprocket, and a processor for processing the measurement obtained by the instrument as operation support operating data corresponding to the amount of rotation of the driven sprocket, wherein the processor comprises:

setting means for determining a reference halted position of the chain every time the chain is moved a distance by intermitting driving during one turn of movement, means for computing the actual halted position of the chain corresponding to the reference halted position based on the measurement obtained by the instrument, and means for computing the deviation of the actual halted position of the chain from the reference halted position.

2. A conveyor according to claim 1 wherein the processor comprises setting means for determining a reference position of the chain in time series when the chain is moved a distance at a time by intermitting driving, means for computing the actual position of the chain corresponding to the reference position based on the measurement obtained by the instrument, and means for computing the deviation of the actual position of the chain from the reference position.

3. A conveyor comprising a pair of drive sprockets, a pair of driven sprockets and a pair of intermittently drivable chains each reeved around the drive sprocket and the driven sprocket corresponding to the chain, the conveyor being characterized in that the conveyor comprises a first instrument for measuring the amount of rotation of one of the driven sprockets, a second instrument for measuring the amount of rotation of the other driven sprocket, and a processor for processing the measurements obtained by the two instruments as operation support operating data, wherein the processor comprises:

setting means for determining a reference halted positions of the respective chains every time the chains are moved a distance by intermitting driving during one turn of movement, means for computing the actual halted position of each of the chains corresponding to the reference halted position based on the measurement obtained by the instrument, and means for computing the deviation of the actual halted position of the chain from the reference halted position.

4. A conveyor according to any of claims 1, 2 and 3 wherein a plurality of container holders are attached to the chain at a spacing corresponding to the distance the chain is moved at a time by intermittent driving.

* * * * *